United States Patent [19]

Kross

[11] Patent Number: 4,722,383

[45] Date of Patent: Feb. 2, 1988

[54] CORD LOCK FOR VENETIAN BLINDS

[75] Inventor: Robert C. Kross, Kearny, N.J.

[73] Assignee: Levolor Lorentzen, Inc., Parsippany, N.J.

[21] Appl. No.: 922,728

[22] Filed: Oct. 24, 1986

[51] Int. Cl.[4] ..... E06B 9/324

[52] U.S. Cl. ..... 160/178 C; 160/168 R

[58] Field of Search ..... 160/178 C, 168 R, 178 R

[56] References Cited

U.S. PATENT DOCUMENTS

| | | | |
|---|---|---|---|
| 3,799,236 | 3/1974 | Debs | 160/178 C |
| 3,952,789 | 4/1976 | Marotto | 160/178 C |
| 4,245,688 | 1/1981 | Vecchiavelli | 160/178 C |

*Primary Examiner*—J. Franklin Foss
*Assistant Examiner*—David L. Talbott

[57] ABSTRACT

A cord lock for locking a venetian blind in its raised position only. The lock has a housing with spaced side walls spanned by a smooth-surface pin, a knurled roller slidably received in slots in the side walls, a plastic lever below the pin and roller and having an extension below the blind head. The lift cords of the blind pass between the pin and roller. The extension is engaged by the top-most slat of the blind which lifts the lever and knurled roller thereby causing the lift cords to draw the knurled roller up the slot locking the lift cords between the roller and pin.

4 Claims, 9 Drawing Figures

CORD LOCK FOR VENETIAN BLINDS

BACKGROUND OF THE INVENTION

The present invention relates to cord locks for venetian blinds, and more specifically to a cord lock called a top lock in the venetian blind art. This type of cord lock permits locking of the blind only when it is fully raised, but not at any intermediate positions between the fully raised or a fully lowered position. This is desirable for a building with a large number of blinds and where blinds standing at miscellaneous heights would create an unattractive appearance from the outside. For this reason, or perhaps other reasons, building owners may want to have the blinds at either a fully raised or a fully lowered position, but at no intermediate positions.

Top locks of this type are known, for instance from U.S. Pat. No. 3,799,236. The top lock disclosed in this patent is relatively complicated.

It is an object of the present invention to provide a new top lock, especially adapted for mini-blinds and micro-blinds.

BRIEF DESCRIPTION OF THE DRAWING

The invention will now be described with reference to the accompanying drawings, in which.

DETAILED DESCRIPTION OF A PREFERRED EMBODIMENT

Figure 1:
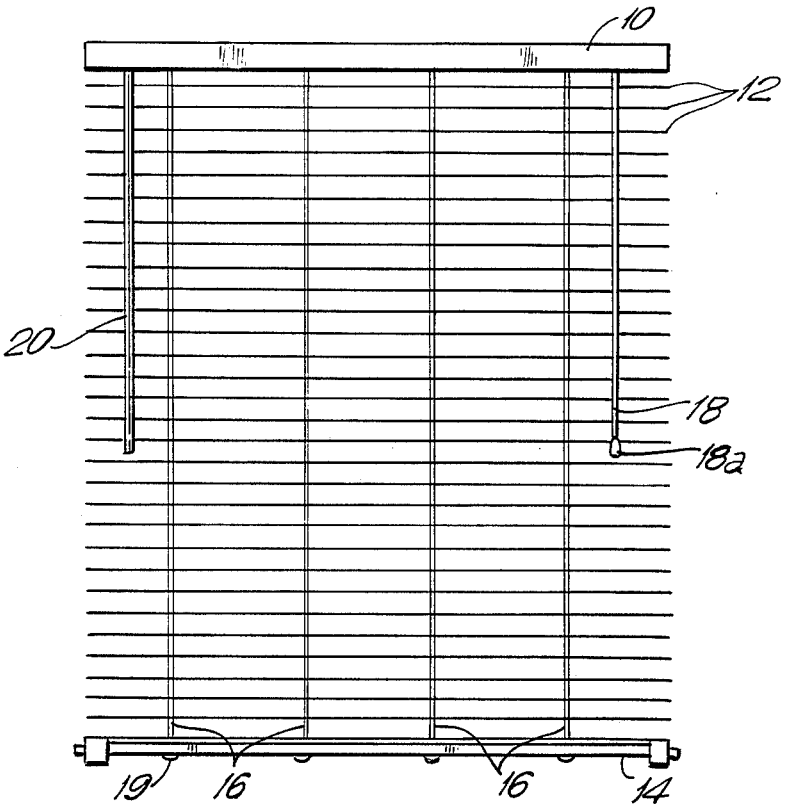
FIG. 1 is a front view of a fully lowered venetian blind.
Figure 2:
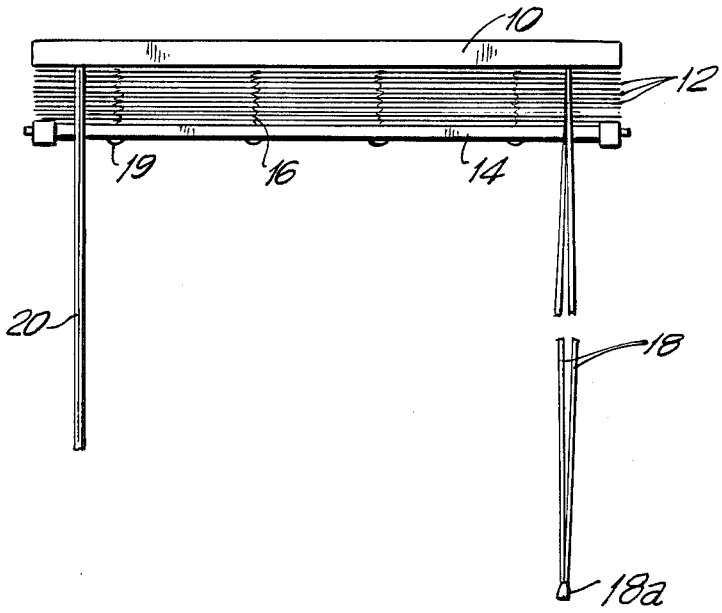
FIG. 2 is a front view of the venetian blind of FIG. 1 when fully raised.
Figure 3:
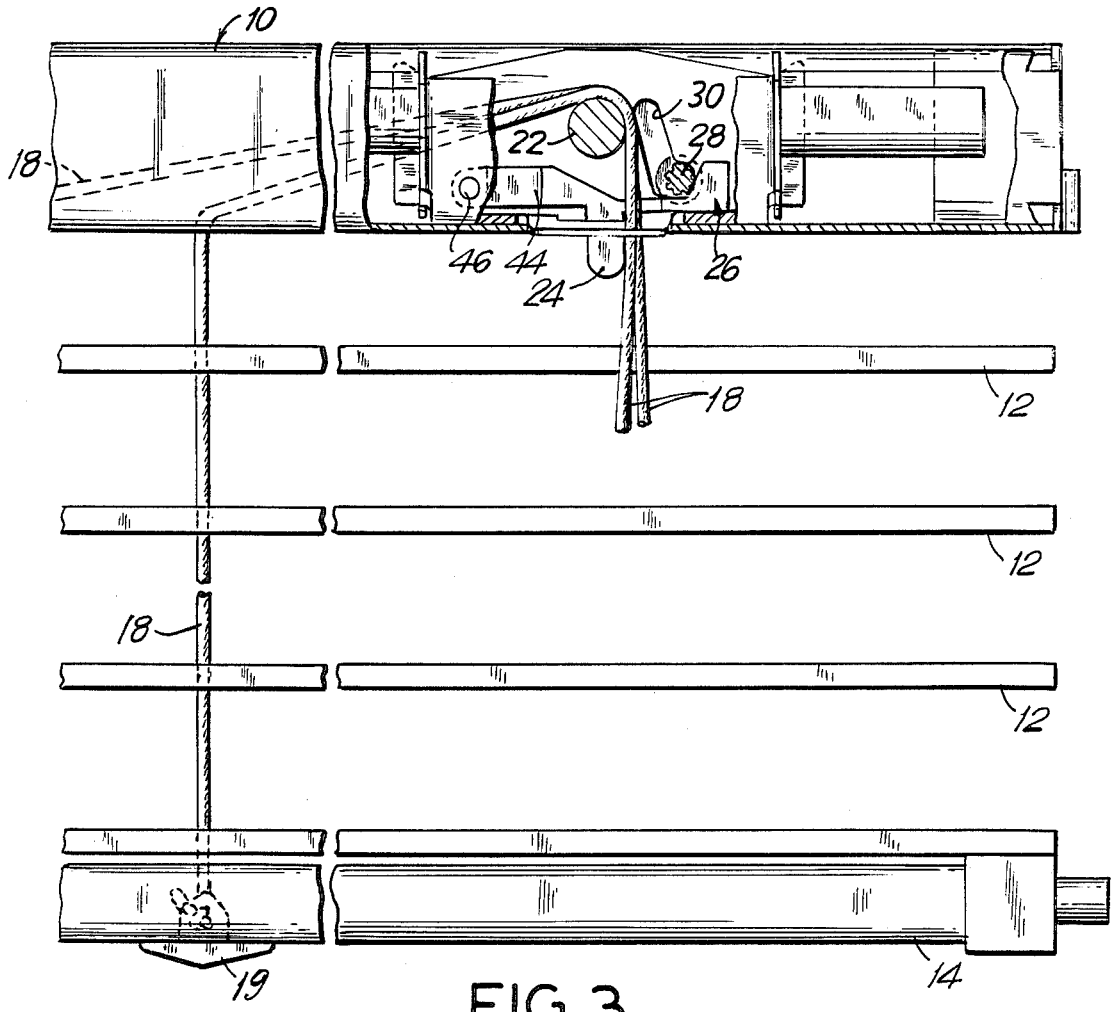
FIG. 3 is an enlarged sectional view of the blind of FIG. 1, incorporating the top lock of the present invention in the head of the blind.

Referring now to FIGS. 1 and 2, these figures show a conventional venetian blind having a venetian blind head 10 from which are suspended slats 12 and a bottom rail 14, by means of ladders 16. In conventional manner the bottom rail and thereby the slats can be raised or lowered by means of two lift cords 18 attached to the bottom rail by caps 19 and passing through slots (not shown) in slats 12. As likewise well known in the art slats 12 can be tilted to different positions by a wand 20.

The venetian blind head 10 is provided with a so-called top lock shown in greater detail in FIGS. 3 to 9. It comprises a housing 32 having two parallel side walls 34,35 joined by a bottom wall 36. Side walls 34,35 extend lengthwise of blind head 10. At the ends of the side wall 35 there are wings 38 which snap under flange **10*a* of blind head 10 while a lip 40 is received within a cut-out 42 in blind head 10. A lever 26 located between the side walls 34,35 has an extension 24 protruding below the blind head through a cut-out 42 and an opening 43 in bottom wall 36. Lever 26 consists of plastic material and has a crank-like U-shaped portion 44 which is journalled by pivots 46 in walls 34, 35 of housing 32**.

Figure 4:
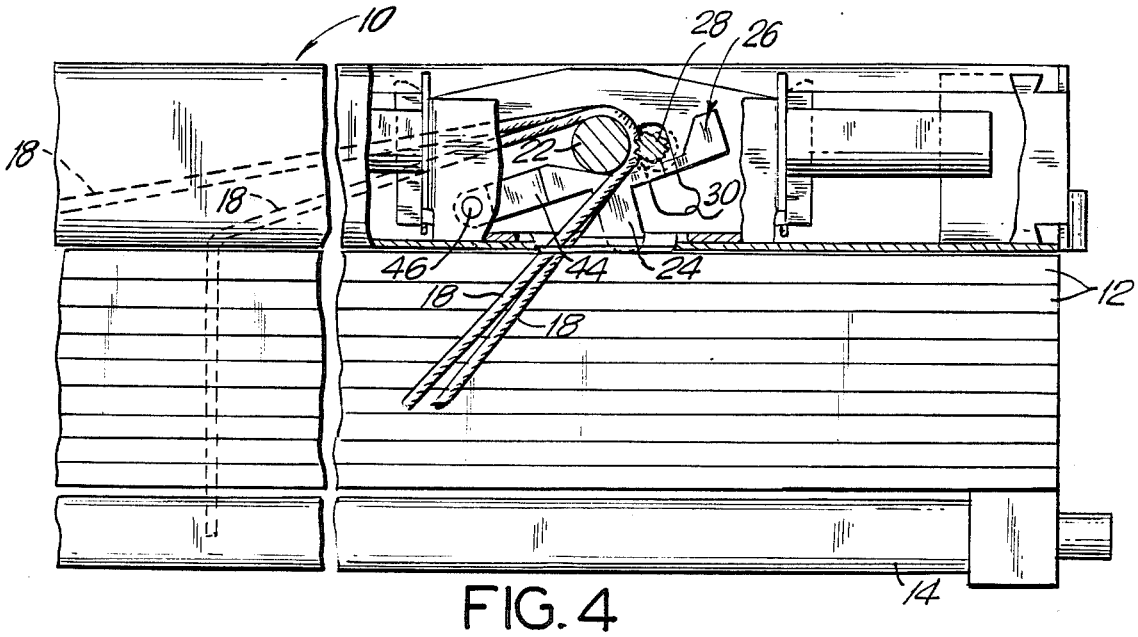
FIG. 4 is an enlarged sectional view similar to that of FIG. 3, but with the venetian blind fully raised.
Figure 5:
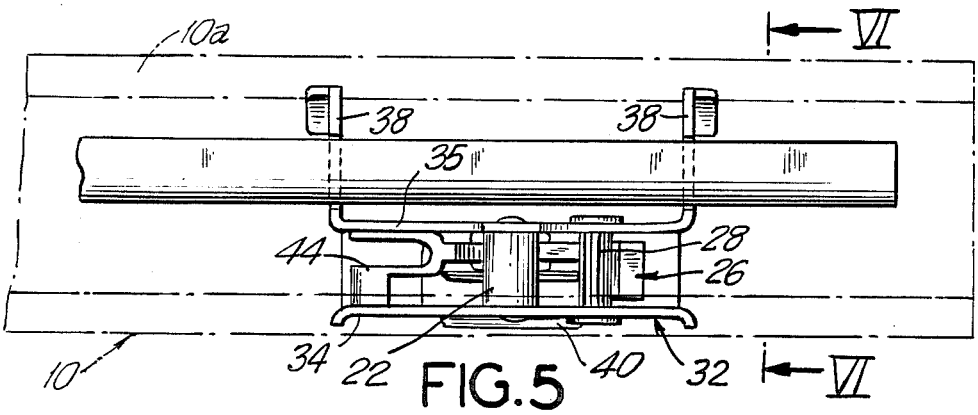
FIG. 5 is a top view of the top lock.
Figure 6:
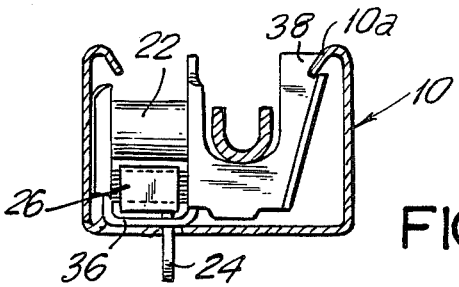
FIG. 6 is a sectional end view of the top lock, taken along the line VI—VI of FIG. 5.
Figure 7:
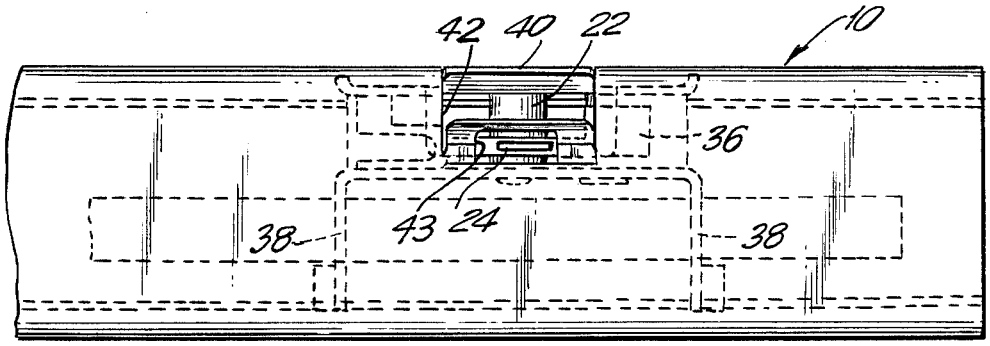
FIG. 7 is a bottom view of the blind head and of the top lock.
Figure 8:
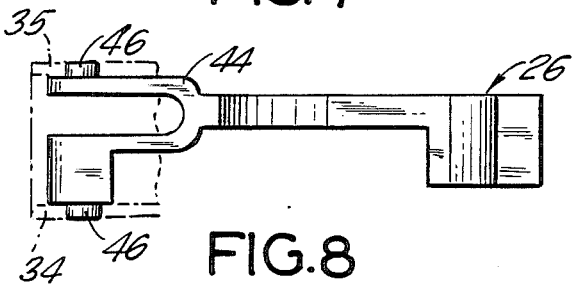
FIG. 8 is a top view of a part of the top lock.
Figure 9:
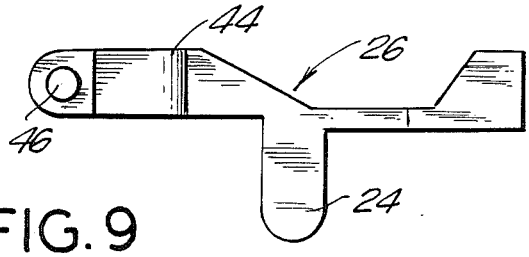
FIG. 9 is a side view of FIG. 8.

The lift cords 18 pass from one side of the blind, the right hand side in the embodiment shown in FIG. 1, through the top lock in the blind head and from there between the ladders 16. The lift cords 18 pass over a smooth roll or fixed pin 22 of the top lock. However, when the blind has been completely raised, as shown in FIG. 4, extension 24 of lever 26 of the top lock will be raised by the top-most slat 12 and cause a knurled rivet 28 in an L-shaped slot 30 of the top lock to be lifted by the lever 26 so as to contact the lift cords 18. The knurled rivet 28 is drawn up slot 30 by the lift cords 18 locking the lift cords 18 between pin 22 and rivet 28. When the blind is to be lowered again, pulling downwardly at ends **18*a* of the cords 18 will cause the knurled rivet 28 to disengage from cords 18 and slide downward within slot 30. This frees the cords 18**, and the blind will be lowered by gravity.

What is claimed is:

1. A cord lock for use in a venetian blind having a ladder-and-slat assembly suspended beneath a head of the blind, the blind being raised and lowered by lift cords which pass through the cord lock and hang down for manual manipulation to raise and lower the blind, and the top slat of the blind moving upwardly as the blind is raised into uppermost position, said cord lock comprising: a housing fastened in said blind head, said housing having two spaced side walls and also a bottom wall with an opening, a pin having a smooth surface and fastened to and spanning the space between said side walls, two slots respectively arranged in said two side walls adjacent said pin and aligned with each other, a knurled roller slidably received in said slots, the lift cords extending through said opening and between said pin and said roller, and a lever pivotally arranged in said housing and extending above said bottom wall and below said roller and said pin, said lever having an extension extending through said opening and below said housing and said blind head, whereby said lift cords may pass freely over said pin and between said roller and pin when the top slat is disengaged from said extension, but the top slat upon being raised will engage said extension, will lift said lever, and the latter will lift said roller and thereby lock said lift cords between said roller and said pin.

2. A cord lock according to claim 1, wherein said slot is essentially L-shaped and having a relatively short leg adjacent said bottom wall and a relatively long leg extending at an angle upwardly from said relatively short leg into close proximity with said pin.

3. A cord lock according to claim 1, wherein said lever consists of a plastic material.

4. A cord lock according to claim 1, wherein said housing has a pair of wings adapted to snap under a flange of the blind head, and a lip adapted to be received in a cut-out of said blind head.

* * * * *

UNITED STATES PATENT AND TRADEMARK OFFICE

CERTIFICATE OF CORRECTION

PATENT NO. : 4,722,383

DATED : Feb. 2, 1988

INVENTOR(S) : Robert C. Kross

It is certified that error appears in the above-identified patent and that said Letters Patent are hereby corrected as shown below:

[75] Inventors: Robert C. Kross, Kearny, N.J. and
Otto Kuhar, Garfield, N.J.

Signed and Sealed this

Nineteenth Day of July, 1988

*Attest:*

DONALD J. QUIGG

*Attesting Officer*

*Commissioner of Patents and Trademarks*